United States Patent [19]

Lucas et al.

[11] Patent Number: 4,574,198

[45] Date of Patent: Mar. 4, 1986

[54] METHOD AND DEVICE FOR PRODUCING PHOTONS IN THE ULTRAVIOLET-WAVELENGTH RANGE

[76] Inventors: Amand A. Lucas, Croix Andre 3, 4150 Nandrin, Belgium; Jack C. Rife, Suite 209 - 2710 Macomb St., NW., Washington, D.C. 20008; Stephen E. Donnelly, 7 Canberra Grove, Brighton East, Victoria 3187, Australia

[21] Appl. No.: 576,386

[22] PCT Filed: May 5, 1983

[86] PCT No.: PCT/BE83/00010

§ 371 Date: Jan. 9, 1984

§ 102(e) Date: Jan. 9, 1984

[87] PCT Pub. No.: WO83/04099

PCT Pub. Date: Nov. 24, 1983

[30] Foreign Application Priority Data

May 7, 1982 [LU] Luxembourg ..... 84136

[51] Int. Cl.[4] ..... G21G 4/00

[52] U.S. Cl. ..... 250/493.1

[58] Field of Search ..... 250/493.1, 494.1, 504 R

[56] References Cited

PUBLICATIONS

"Trapping of Low-Energy Helium Ions in Niobium" by R. Behrisch et al., *Journal of Nuclear Materials*, vol. 56, No. 3 (1975), North Holl. Publ. Comp., Amsterdam (NL), p. 365.

"Time-Dependent Study of Vacuum-Ultraviolet Emission in Argon" by N. Thonnard et al., *Physical Review A*, vol. 5, No. 3 (Mar. 1972), Inst. of Phys., New York (US)., pp. 1111-1112.

"Continuous Emission in the Vacuum Ultraviolet Under Energetic Inert Gas Ion Bombardment of Aluminium" by R. S. Bhattacharya et al., *J. Phys. D: Appl. Phys.*, vol. 11 (1978), Letchworth (GB), pp. 1935-1939.

*Primary Examiner*—Bruce C. Anderson

*Attorney, Agent, or Firm*—Fleit, Jacobson, Cohn & Price

[57] ABSTRACT

Method and device for producing photons (7), in the UV-wavelength range, comprising planting in a solid matrix, ions from a gas which is inert or insoluble relative to the matrix, excitating the captive gas (2) in the solid matrix, and emitting of said photons (7) by the excitated gas, as well as notably the ionic bombardment of one surface from the solid matrix with low-energy ions from at least one gas as stated above, and the electronic bombardment (4) with low energy of the solid matrix, with emission of the photons (7).

23 Claims, 4 Drawing Figures

METHOD AND DEVICE FOR PRODUCING PHOTONS IN THE ULTRAVIOLET-WAVELENGTH RANGE

This invention relates to a method for producing photons in the UV-wavelength range, which comprises planting in a solid matrix, ions from a gas which is inert or insoluble relative to the matrix, excitating the gas being retained captive as extended faults of the solid matrix, and radiating said photons by the excitated gas, as well as to a device for the working of this method.

The usual light sources for the near, far and extreme UV-wavelengths, are generally discharge sources where the light is produced by passing an electric discharge through a capillary element containing noble gases or similar under pressures lying between 10 and a few ten-thousands Pa. For He, a commonly-used gas, a continuous emission spectrum results from the forming in the discharge and the subsequent radiative decrease, of excitated helium molecules $He_2^*$.

Another main radiation source in this spectrum range is the synchrotron which is a complex and costly equipment, available in a few locations only in the world.

It has also been considered to use the fluorescence of liquid helium as radiation source in the UV range, but this method requires a cryogenic cooling, thus at very low temperatures, as well as a differential pumping, and the working thereof is thus very costly (see C. M. Surko, R. E. Packard, G. J. Dick and F. Reif, Spectroscopic Study of the luminescence of liquid helium in the vacuum ultraviolet, in *Physical Review Letters*, Vol. 24, Nr. 12 (1970), p. 657 and ff.).

It is known on the other hand to prepare solid matrixes having extended faults, such as gap agglomerates, or bubbles containing a gas which is inert or insoluble relative to the matrix. There is for example obtained such a matrix with helium microbubbles by bombardment by means of energizing He ions. The Al/He matrix has been the object of spectroscopy studies for optic absorption and electronic power loss (see J. C. Rife, S. E. Donnelly, A. A. Lucas and J. J. Ritsko, Optical absorption and electron-energy-loss spectra of helium microbubbles in Aluminum, *Physical Review Letters*, Vol. 46, Nr.18 (1981), p. 1220 and ff.).

It has finally been noticed that a solid matrix bombed by means of high-energy helium ions (200–600 keV) emits, from some He proportion on, a continuous spectrum in the UV range (see R. S. Bhattacharya, K. G. Lang, A. Scharmann and K. H. Schartner, Continuous emission in the vacuum ultraviolet under energetic inert gas ion bombardment of aluminum, in *J. Phsy.D*, vol. 11 (1978), p. 1935 and ff.). It is to be noted that the planting of high-energy helium ions is a relatively costly method and that as the helium ions are planted at a deep depth inside the matrix, the intensity of the UV emission is low.

The present invention has for object to develop a method and a device for producing photons in the UV-wavelength range, which are simple and of low-cost while giving comparable results to the discharge sources.

For this purpose according to the invention, one performs an ion bombardment of the surface from the solid matrix with low-energy ions from at least one gas such as mentioned above, so as to obtain a low-depth planting of gas in the solid matrix, and thereafter a low-energy electronic bombardment of the solid matrix, with an excitating of the captive gas and emission of said photons.

According to one embodiment of the invention, the method comprises the planting at low depth of gas ions through one side of a mass solid matrix, and the electronic bombardment of this same side with emission of said induced photons from this side.

According to another embodiment of the invention, the method comprises the planting at low depth of gas ions inside a laminated solid matrix with a thickness smaller than 1 μm, and said electronic bombardment of the one side of this matrix with emission of said induced photons from the other side of the matrix.

There is also provided according to the invention, a device for the working of the method according to the invention, this device comprising a vacuum enclosure, a solid matrix, into which are planted at low depth ions from at least one gas which is inert or insoluble relative to the matrix, this matrix being mounted on a support inside the vacuum enclosure, an electron-producing apparatus capable of subjecting the matrix to a low-energy electronic bombardment, and an electric connection connecting the matrix to the outside, as well as an outlet for the resulting photons, provided in the enclosure.

Other details and features of the invention will stand out from the description given hereinafter in a non-limitative way and with reference to the accompanying drawings.

In the figures, identical or similar elements are marked with the same references.

Figure 1:
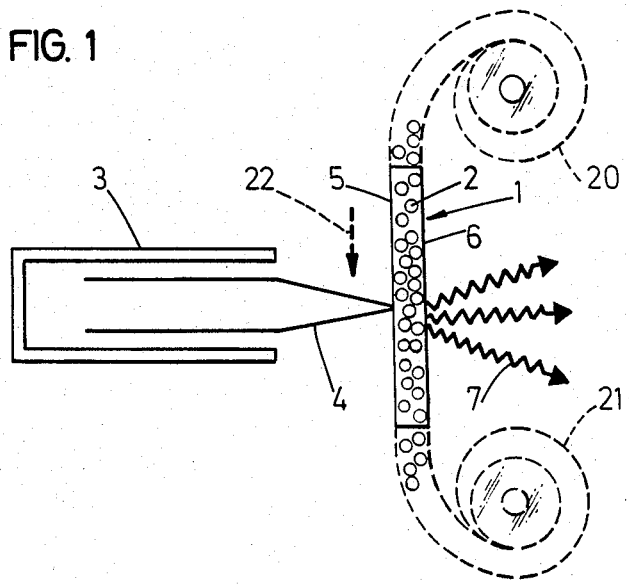
FIG. 1 shows diagrammatically a device for the working of a method for producing photons according to the invention.

The device shown in FIG. 1 comprises a solid matrix 1 which is prepared by planting low-energy He ions into an Al sheet with a thickness smaller than μm. A bombardment with low-energy He ions, about 5 keV, allows planting a high He concentration (locally more than 10 atoms) over a thickness from a few tens to some thousands Å. The helium does agglomerate naturally in the matrix gaps obtained with the bombardment and forms extended faults, such as gap agglomerates or microbubbles 2 which remain stable at room temperature and may resist to temperature increases up to a few hundreds °C., for example up to 300° C.

The device shown in FIG. 1 also comprises an apparatus for producing low-energy electrons 3, such as an electron gun, said apparatus casting an electron beam 4 on the one side 5, the so-called back side, of matrix 1. The electrons 1 from the electron beam 4 advantageously have an energy smaller than or equal to 20 keV, preferably lying between 1 and 5 keV. A fluorescence of the target is induced in such a case from the front side 6 of the matrix, the photon emission being shown by wavy-line arrows 7.

There has been shown in this FIG. 1, in broken lines, a variation of embodiment in which the laminated matrix 1 is in the shape of a continous strip, wound at the one end into a supply roll 20 and at the other end thereof in a discharge roll 21. In this way, when that part of the matrix being subjected to the electronic bombardment is accidendtally affected after some operating time, it is possible to move said matrix in the direction of arrow 22, by rotating said rolls 20 and 21, and to bring in front of the electron beam a new matrix part not yet subjected to the electronic bombardment. This moving may be performed manually or automatically, and it may be continuous or intermittent during the operation of the device according to the invention.

Figure 2:
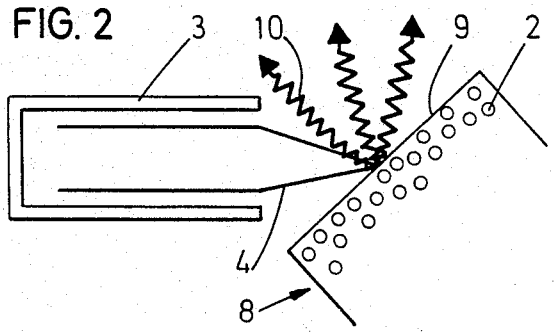
FIG. 2 shows diagrammatically a device for the working of a variation of embodiment of the invention.

In the device shown in FIG. 2, the matrix is a mass substrate 8. The planting of the He ions is performed in the same way as for the laminated matrix 1, by proceeding in such a way as to obtain a maximum concentration of He microbubbles 2 at a depth preferably less than 5,000 Å. In this case, the electron gun 3 casts a low-energy electron beam on the same surface as the one through which the He ions have been planted, and a fluorescence of the target is then induced through this surface 9, the photon emission being shown by wavy-line arrows 10. One thus has in this latter case what will be called an electronic bombardment of the matrix front side, as opposed to the electronic bombardment of the matrix back side shown in FIG. 1.

Figure 3:
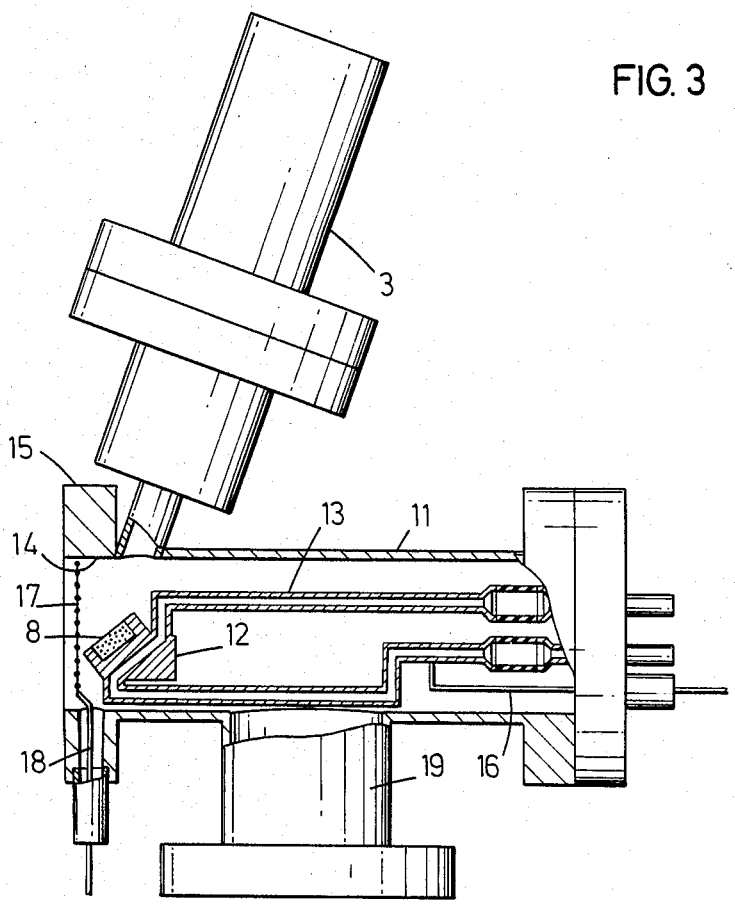
FIG. 3 shows with more details a view partly in axial section through a device according to the invention.

The device shown in FIG. 3 shows with more details a device performing an electronic bombardment of the matrix front side.

This device according to FIG. 3 comprises an enclosure 11 retained under vacuum, inside which the matrix 8 is mounted on a support 12 which may be cooled by a cooling circuit 13, for example with water, in the possible case of using the device under high intensity. A electron gun 3 emitting an electron beam with low energy and adjustable intensity, is mounted on the enclosure so as to direct this beam on the matrix. The angle of incidence between the beam and the matrix plane is computed in such a way that the emitted photons may propagate through the outlet opening 14 formed at the one end of the enclosure 11. This end is provided with a flange 15 which is used for the connection of the device according to the invention to an apparatus in which the UV light will be used.

An electronic connection 16 notably allows to measure the electric current in the matrix. It is possible to provide in the outlet opening 14, an electronic screen 17 intended to avoid any escape of electrons through this opening, this electronic screen 17 then also being connected to the outside through an electric connection 18.

The enclosure 11 is retained under vacuum either by a pumping device not shown, connected to the enclosure through the flanged fitting 19, or by the pumping device retaining under vacuum the apparatus not shown connected to the flange 15.

The matrix material has to fulfill two main conditions; the gas insolubility in the matrix, and a relatively low absorption by the matrix of the continuous gas emission continuum. The matrix material should preferably have such optical properties that the escape depth of the photons being produced be compatible with the planting depth. Consequently, it is not necessary, that the penetration depth of the electron beam be deeper than this penetration depth of the photons, and electron energies in a range from 0.1 to 20 keV are sufficient, with a relatively razing incidence. This property of the photon source allows to avoid the high costs required for obtaining high-energy ionic and electronic bombardments, such as the ones used in the known methods and devices. The excitating may notably be produced by using a low-energy electron gun.

As matrix material use may be made advantageously of the materials selected among the group comprising metals, such as Sn, Al, Mg, semiconductros, such as Si, or some insulating materials.

As the emission depth of the source is very short, the source is substantially flat, and the surface and the shape of the source may be simply adjusted by structuring the electron beam. By focalizing the beam, it is possible to obtain an effective pin-point source; by scanning or spreading the beam, it is possible to obtain an extended source compatible for example, with the geometry of the slit used in some spectroscopic works. Moreover, a fluorescence intensity varying in time may easily be obtained by modulating the electron beam with pulses, which allows the use of the source in servo techniques ("lock-in type"). The life duration of the fluorescence is less than 10 sec.

Figure 4:
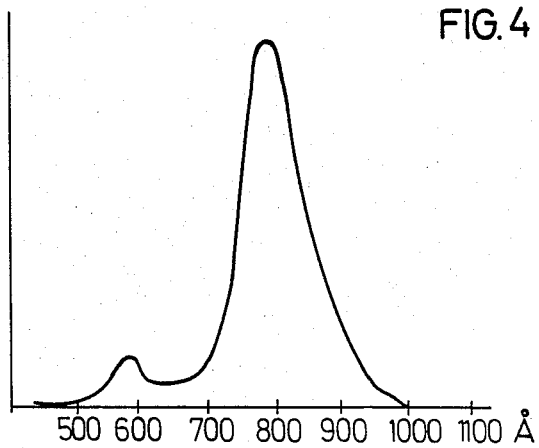
FIG. 4 shows the fluorescence spectrum obtained when using a device according to the invention. The units marked in abcissae show the wavelengths of the fluorescence spectrum, and in ordinates are marked arbitrary units for the emission strength.

According to a non limitative example of working the method according to the invention, a photon source on the basis of Al/He is prepared in the above-described way and operated according to the invention under an electronic bombardment having an energy of 3800 V. This source generates at it appears from the FIG. 4, a continuous fluorescence spectrum which extends from 580 to 900 Å, which is similar to what is obtained with the conventional discharge source. The photon production from the matrix has been compared to the synchrotron source SURF II and this comparison shows an efficiency higher than or equal to $10^{-4}$ photons per electron. With a sufficient electric current, the brightness may reach the one obtained with discharge lamps.

To the difference of the conventional discharge sources, there is the possibility by means of the method according to the invention, of designing a multi-gas composite source with a view to extending the width of the spectrum band from 580 to 3000 Å. Indeed it is clear that besides helium, other inert gases relative to the matrix may be used, for example rare gases or other gases, such as Ne, Ar, . . . , $H_2$, $N_2$, . . . . When ions from a plurality of such gases are planted in the matrix, it is thus possible to obtain said multi-gas composite source.

The applications of a photon source according to the invention are numerous. It is possible to use same in any application where the discharge sources are presently used, for example for the photon-electronic spectroscopy in the ultraviolet, for reflectivity, adsorption and photoconductivity studies, etc.

Besides the use of the device according to the invention as simple means for producing photons in the near, far- and extreme UV range, the source according to the invention may be incorporated in a large number of new more intricate systems. It is notably possible to mention:

(a) particle sensors, by detecting the fluorescence being induced in the device due to the passage of charged particles;

(b) contact lithography in the ultraviolet, by planting in an integrated circuit by means of an inert gas ion beam on a mask in the shape of a thin film and by later printing the circuit, by locating the film in contact with a photoresist coating which is sensitive to the UV photons, and by bombardment with an electron beam to activate the UV fluorescence;

(c) stimulated emission source for extreme ultraviolets (excimer laser), by means of the choice of a suitable pumping mechanism and a suitable resonant cavity.

The methods and devices according to the invention have the advantage of not requiring a differential pumping, a gas replacement and a cryogenic cooling. Moreover they are very easy to operate and have a flexible working. The source according to the invention has the advantage of a brightness which may vary by six magnitude orders or more, by modifying the electron beam intensity. It does allow a pin-point geometry by focalizing. Finally, the working thereof is relatively cheap.

It must be understood that the present invention is in no way limited to the above-described embodiments and that many changes may be brought thereto without departing from the scope of the present patent.

We claim:

1. Method for producing photons in the UV-wavelength range, comprising the steps of:
   planting in a solid matrix, ions from a gas which is inert or insoluble relative to the matrix by performing an ionic bombardment of one surface from the solid matrix with low-energy ions from at least one said gas in such a way as to obtain a low-depth planting of the gas ions in the solid matrix;
   and thereafter excitating the captive gas in the solid matrix by electronic low-energy bombardment of the solid matrix; and
   radiating and emitting said photons from the solid matrix due to the excitated gas.

2. Method according to claim 1, characterized in that the method includes low-depth planting of gas ions through one side of a mass solid matrix, and the electronic bombardment of said one side results in the emission of said photons being induced from said one side.

3. Method according to claim 1, characterized in that the method comprises low-depth planting of gas ions in a laminated solid matrix with a thickness smaller than 1 μm, and performing said electronic bombardment of the one side of said matrix with emission of said photons being induced from the other side of the matrix.

4. Method according to claim 1, characterized in that the method comprises intermittently or continuously moving the matrix, in which the gas ions have been planted, from a supply position to a bombardment position where same undergoes said electronic bombardment, then to a discharge position, the matrix being in the shape of a continuous substrate.

5. Method according to claim 1, characterized in that the ionic bombardment is performed with ions from said gas or gases having an energy allowing to obtain a high gas concentration in the form of extended faults of the matrix over a depth which does not exceed a few thousands Å.

6. Method according to claim 5, characterized in that the energy of said gas ions is in the range of 5 keV.

7. Method according to claim 1, characterized in that the method comprises low-depth planting in the matrix of ions from a plurality of gases which are inert or insoluble relative to the matrix.

8. Method according to claim 1, characterized in that the method comprises planting ions from rare gases, particularly helium.

9. Method according to claim 1, characterized in that the electronic bombardment is performed with electrons having an energy which is lower than or equal to 20 keV, preferably between 1 and 5 keV.

10. Method according to claim 1, characterized in that the method comprises during the electronic bombardment, focalizing an electron beam on the matrix so as to form a pin-point source of photons.

11. Method according to claim 1, characterized in that the method comprises during the electronic bombardment, scanning the matrix with an electron beam so as to form an extended source of photons.

12. Method according to claim 1, characterized in that the method comprises during the electronic bombardment, spreading an electron beam so as to form an extended source of photons.

13. Method according to claim 1, characterized in that the method comprises during the electronic bombardment, modulating the intensity of the electron beam so as to form a varying-intensity source of photons.

14. Method according to claim 1, characterized in that the matrix being used is from a material having a low absorption of the continuous emission spectrum of the excitated gas, contained inside the matrix.

15. Method according to the claim 14, characterized in that the matrix being used is from a material selected in the group consisting of metals, such as Sn, Mg, Al, semi-conductors, such as Si, Ge, or insulating materials, such as LiF, NaCl.

16. Device for producing photons in the UV-wavelength range comprising:
   a vacuum enclosure;
   a solid matrix being mounted on a support inside said vacuum enclosure;
   means for implanting at low depth, ions from at least one gas which is inert or insoluble relative to the matrix;
   an electron-producing means for subjecting the matrix to a low-energy electronic bombardment;
   an electric connection means for connecting the matrix to the outside of said vacuum enclosure; and
   an outlet provided in the enclosure for the resulting photons.

17. Device according to claim 16, wherein said solid matrix is a mass solid matrix, one surface of which contains implanted gas ions, the electron-producing means being positioned so as to perform said electronic bombardment of said one surface, and said one surface emitting the induced photons therefrom.

18. Device according to claim 16, wherein the solid matrix comprises a laminated solid material with a thickness smaller than 1 μm, the electron-producing means being positioned so as to perform said electronic bombardment of one side of the matrix and the other side of the matrix emitting the induced photons therefrom.

19. Device according to claim 16, wherein the matrix is in the shape of a continuous substrate, and the deivce includes movable means for moving the matrix inside the enclosure in an intermittent or continuous way between a supply position, a matrix-bombardment position, and a discharge position.

20. Device according to claim 16, characterized in that the device includes a cooling circuit for the matrix support.

21. Device according to claim 16, characterized in that the enclosure has a connecting flange about said outlet for the resulting photons, the device including a vacuum apparatus mounted on said flange, and an electron screen connected across said outlet to the outside.

22. Device according to claim 16, characterized in that the electron-producing means for low-energy bombardment is an electron gun generating electrons having an energy lower than or equal to 5 keV.

23. Device according to claim 16, characterized in that the device includes a vacuum pump connected to the vacuum enclosure.

* * * * *